United States Patent [19]

Müller

[11] 4,116,427

[45] Sep. 26, 1978

[54] APPARATUS FOR STUFFING NEWSPAPERS OR THE LIKE

[75] Inventor: Hans Müller, Zofingen, Switzerland

[73] Assignee: GRAPHA-Holding Ag., Hergiswil, Switzerland

[21] Appl. No.: 764,631

[22] Filed: Feb. 1, 1977

[30] Foreign Application Priority Data

Feb. 19, 1976 [CH] Switzerland ..... 2025/76

[51] Int. Cl.[2] ..... B65H 39/02

[52] U.S. Cl. ..... 270/54; 270/55

[58] Field of Search ..... 270/54–58; 271/64, 173

[56] References Cited

U.S. PATENT DOCUMENTS

| | | | |
|---|---|---|---|
| 3,450,400 | 6/1969 | Guggisberg | 270/55 |
| 3,627,302 | 12/1971 | Dutro | 270/55 |
| 3,825,246 | 7/1974 | Elia | 270/54 |

*Primary Examiner*—Edgar S. Burr
*Assistant Examiner*—A. Heinz
*Attorney, Agent, or Firm*—Peter K. Kontler

[57] ABSTRACT

A newspaper stuffing apparatus wherein a succession of pockets is transported below at least one stuffer having a bottom-feed hopper for newspaper jackets and one or more additional bottom-feed hoppers for inserts which are dropped into the jackets upon admission of jackets into successive pockets. The thus assembled newspapers are removed from successive pockets by sets of jaws in the tooth spaces of a toothed wheel which rotates at a level below the path of the pockets and transfers withdrawn newspapers onto a conveyor system. Each pocket has a recess which is provided in its lower portion and through which the jaws of the wheel withdraw assembled newspapers during travel of filled pockets above the wheel. Pivotable levers are employed to prevent the jackets and their inserts from leaving the respective pockets by way of the recesses during travel of pockets toward the wheel. The jaws can withdraw the newspapers from successive pockets at a speed which exceeds the speed of evacuation of newspapers by gravity alone.

11 Claims, 4 Drawing Figures

APPARATUS FOR STUFFING NEWSPAPERS OR THE LIKE

BACKGROUND OF THE INVENTION

The present invention relates to improvements in apparatus for collating and otherwise manipulating sheet material articles, particularly sections of newspapers or the like. More particularly, the invention relates to improvements in so-called stuffing apparatus which can be used for assembly of newspapers in openable pockets which are transported past several hoppers, preferably bottom-feed hoppers each of which can discharge into successive pockets a different sheet material article.

In presently known newspaper stuffing apparatus, each pocket which contains an assembled newspaper is opened at a discharging station so that the newspaper can descend by gravity, e.g., onto a conveyor which delivers it to a stacker or to another processing unit. Such mode of evacuating the contents of pockets is satisfactory as long as the speed of the pockets (which normally travel along an endles path) does not exceed a predetermined value. Once the predetermined speed is exceeded, the interval of time which elapses for gravitational descent of an assembled newspaper from the pocket at the evacuating station is too long, i.e., the speed of the entire apparatus must be reduced for the sole purpose of insuring complete evacuation of assembled newspapers at the evacuating station. Otherwise stated, the capacity of stuffing apparatus is not utilized to a maximum degree because the inertia of assembled newspapers is too high, i.e., it takes too long to accelerate an assembled newspaper from zero speed to that speed at which the newspaper moves during the last stage of its evacuation from the respective pocket.

OBJECTS AND SUMMARY OF THE INVENTION

An object of the invention is to provide an apparatus for collating and otherwise manipulating sheet material articles, particularly a newspaper stuffing apparatus, wherein the intervals which are required for evacuation of collated articles from successive pockets are or can be made much shorter than in heretofore known apparatus so that the speed of the pockets need not be limited for the sole purpose of insuring complete evacuation of their contents at the locus where the collated articles (e.g., assembled newspapers wherein a jacket contains one or more inserts) leave the pockets to be transported to a stacker or the like.

Another object of the invention is to provide the apparatus with novel and improved means which insures that the contents of pockets can be removed at a speed exceeding the speed of removal of such contents by gravity alone.

A further object of the invention is to provide the apparatus with novel and improved pockets and with novel and improved means for preventing the contents of pockets from changing their position (particularly from prematurely leaving the pockets by gravity) before the pockets reach the removing station or stations.

An additional object of the invention is to provide novel and improved means for positively gripping and rapidly removing assembled or collated sheet material articles from the openable pockets of a newspaper stuffing or analogous apparatus.

The invention is embodied in an apparatus for collating and otherwise manipulating sheet material articles, particularly in a newspaper stuffing apparatus. The apparatus comprises a plurality of openable pockets, an endless chain conveyor or analogous means for transporting the pockets in a predetermined direction along a predetermined path (preferably along an endless path which is located in a substantially horizontal plane), means for feeding different sheet material articles (e.g., newspaper jackets and newspaper sections or inserts) into successive pockets in at least two different portions of the path, and means for positively withdrawing or removing the contents of successive filled pockets in a further portion of the path which is located downstream of the aforementioned portions, as considered in the predetermined direction. The withdrawing means comprises means for grasping or gripping the contents of pockets in the further portion of the path and for preferably extracting such contents from the pockets at a speed which exceeds the speed of gravitational descent of the contents of a pocket (thus, the length of that interval which is needed to remove the contents of a pocket can be a small fraction of the length of the interval which elapses while the contents leave the pocket by gravity alone). The apparatus preferably further comprises a suitable conveyor system or analogous means for receiving the withdrawn contents of pockets from the gripping means of the withdrawing means. The path along which the pockets are transported is preferably located at a level above the withdrawing means.

Each of the pockets preferably comprises a lower portion having a recess or cutout into which a portion of the contents of such pocket extends, and the gripping means preferably includes at least one set of mobile components and means for moving such mobile components toward the recesses of oncoming pockets as well as relative to each other to thereby grip the aforementioned portion of the contents of a pocket which is located in the further portion of the path. The moving means for the gripping means may include a rotary member (e.g., a wheel) having a plurality of teeth and tooth spaces which alternate with the teeth. The gripping means may include a discrete set of mobile components for each tooth space and such set may include a first jaw on the rotary member and a second jaw which is movable toward and away from the respective first jaw thereby grip a portion of the contents of the pocket in the further portion of the path on movement of the second jaw toward the respective first jaw. The withdrawing means then further comprises means for driving the rotary member in synchronism with the transporting means for the pockets so as to place successive tooth spaces into register with the recesses of successive filled pockets.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
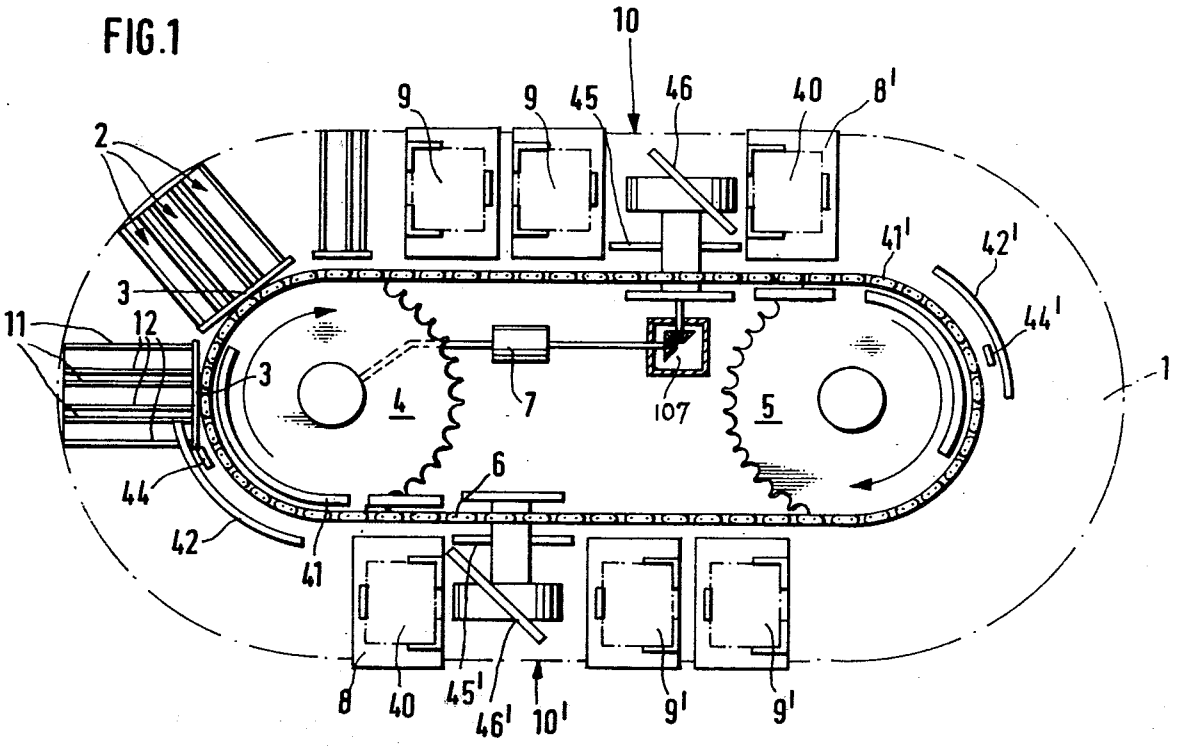
FIG. 1 is a schematic plan view of an apparatus which embodies the invention and comprises two stuffers as well as a discrete withdrawing or removing unit for each stuffer.

FIG. 1 shows certain features of a stuffing apparatus which embodies the invention. The mode of operation of this apparatus is somewhat similar to that of apparatus which are disclosed in U.S. Pat. Nos. 3,874,649 and 3,881,716 to Bryson et al. A chain conveyor which comprises an endless chain 6 trained over two sprocket wheels 4, 5 defines a substantially oval endless path 1 for a series of groups of substantially V-shaped pockets 2. Each group of three pockets 2 is mounted on a plate-like carrier 3 which is secured to the adjacent link of the endless chain 6. The shaft for the sprocket wheel 4 receives torque from a main prime mover 7, e.g., a variable-speed electric motor. The prime mover 7 drives several other components of the apparatus, e.g., through the medium of a bevel gear transmission 107.

Figure 3:
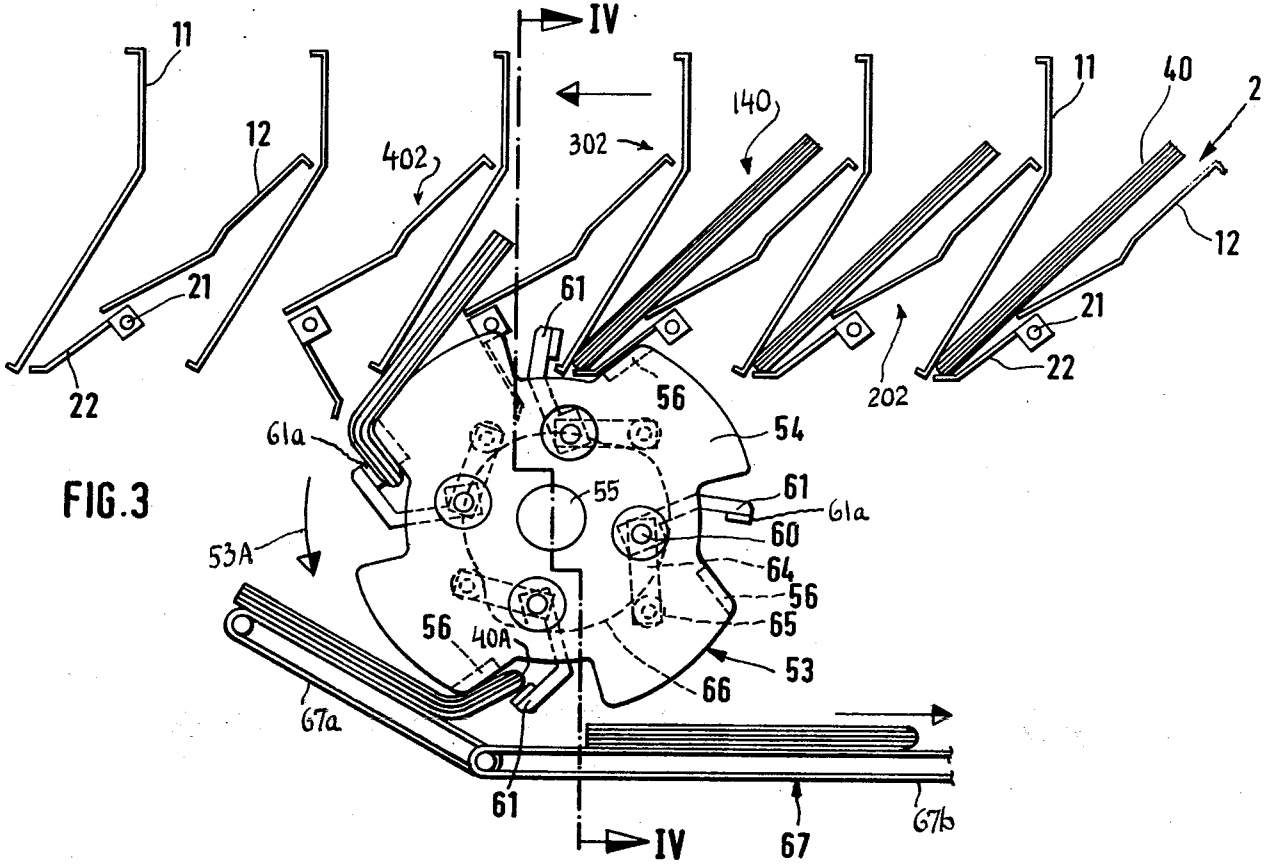
FIG. 3 is a side elevational view of one of the withdrawing units.

The apparatus further comprises two stuffers and two automatic withdrawing or removing units 10, 10' for fully assembled newspapers. The first stuffer comprises a primary bottom-feed hopper 8 for freshly printed jackets 40 (FIGS. 3–4) of newspapers and one or more (e.g., two) additional or secondary bottom-feed hoppers 9 which store inserts (e.g., preprinted sheets or groups of sheets) which are to be inserted into the oncoming jackets 40 to thus convert the jackets and inserts into fully assembled newspapers 140 (FIG. 3). The second stuffer comprises a primary bottom-feed hopper 8' for freshly printed jackets and one or more (e.g., two) additional or secondary bottom-feed hoppers 9' for preprinted inserts. The newspapers are assembled or collated in the pockets 2, and the purpose of the removing units 10 and 10' is to positively withdraw or remove the contents of oncoming pockets 2, preferably at a speed exceeding the speed of evacuation of such contents by gravity alone. Empty pockets 2 which advance beyond the removing unit 10' receive jackets 40 from the primary hopper 8 and inserts from the secondary hoppers 9; the thus assembled newspapers 140 are removed by the unit 10 and each empty pocket 2 which advances beyond the unit 10 receives a jacket 40 from the primary hopper 8' and inserts from the associated secondary hoppers 9'. The thus assembled newspapers 140 are removed by the unit 10' and each empty pocket 2 is then ready to receive a jacket 40 from the primary hopper 8. The jackets 40 and the inserts can descend into the pockets 2 therebelow by gravity, and each jacket 40 is caused to descend in such a way that its folded edge or back 40A (FIGS. 3–4) is caused to enter into the deepmost or lowermost portion of the respective pocket. Hoppers which can be used in the apparatus of FIG. 1 are disclosed, for example, in commonly owned British Pat. No. 901,816 or in Swiss Pat. No. 374,968. The removing units 10 and 10' deposit or otherwise advance successive assembled newspapers 140 onto a single conveyor system 67 (see FIG. 3) or onto two discrete conveyor systems for transport to a further processing station, e.g., to a stacker (not shown).

Figure 2:
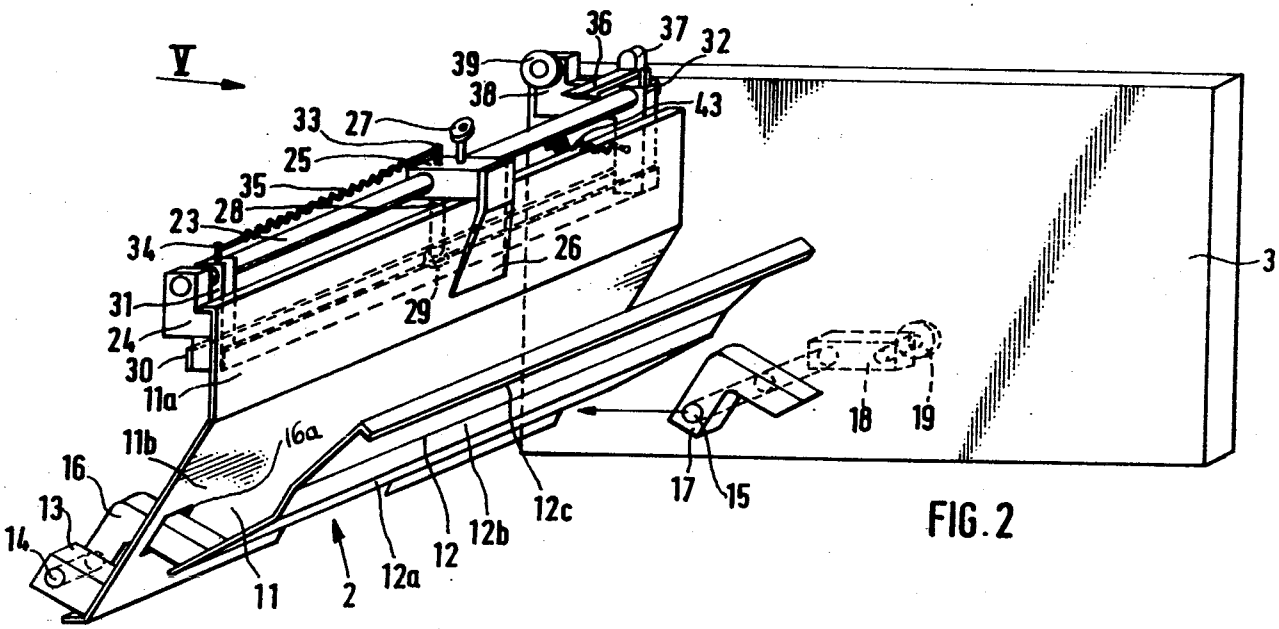
FIG. 2 is enlarged perspective view of one of a large number of pockets in the apparatus of FIG. 1.

FIG. 2 shows certain details of one of the pockets 2. As mentioned above, each plate-like carrier 3 supports a group of three identical pockets 2; however, two pockets of that group which includes the pocket 2 of FIG. 2 have been omitted for the sake of clarity. The illustrated pocket 2 comprises a stationary first wall 11 which is rigid with the carrier 3 and a mobile second wall 12. The first wall 11 includes a substantially vertical upper section or panel **11*a* and a lower section or panel 11*b* which is inclined relative to and makes an obtuse angle with the upper panel 11*a*. The outer side of the lower panel 11*b* (i.e., that side which faces away from the mobile second wall 12) carries a bearing 13 for a stub shaft 14 which is rigid with an L-shaped lever 16 constituting a first support for the wall 12. The stub shaft 14 is coaxial with a second shaft 15 which is rotatably mounted in the carrier 3 and is rigid with a second L-shaped lever 17 constituting a second support for the wall 12. The levers 16 and 17 are disposed at the opposite ends of the wall 11 and each thereof extends through a suitably configurated opening in the lower panel 11*b* (FIG. 2 shows the opening 16*a* for the lever 16). That end portion of the shaft 15 which extends rearwardly beyond the carrier 3 is rigid with a lever 18 for a roller follower 19. The latter tracks a stationary cam 41 or 41' (both shown in FIG. 1) during certain stages of movement of the pocket 2 along the path 1 whereby the roller follower 19 causes the wall 12 to pivot relative to the wall 11 about the common axis of the shafts 14 and 15 at intervals determined by the length and configuration of the cams 41 and 41'. The lever 18 may be biased clockwise, as viewed in FIG. 2, by a suitable spring (not shown), or the roller follower 19 can engage the aforementioned cam 41 or 41' owing to the weight of the wall 12 and of newspaper sections in the pocket 2 so that the wall 12 pivots anticlockwise, as viewed in FIG. 2, toward the adjacent side of the first wall 11 when the roller follower 19 engages the cam 41 or 41'. It is assumed that the wall 12 tends to remain in the open position of FIG. 2 by gravity, i.e., that the wall 12 assumes the illustrated position as soon as the roller follower 19 advances beyond the cam 41 or 41'**.

The wall 12 comprises three sections or panels **12*a*, 12*b* and 12*c*. The lowermost and median panels 12*a*, 12*b* make an obtuse angle which is identical with or closely approximates the obtuse angle between the panels 11*a*, 11*b* of the first wall 11. The uppermost panel 12*c* is disposed in a plane which is substantially parallel to the plane of the lowermost panel 12*a*. When the wall 12 is pivoted against the wall 11, the panels 11*a* and 12*c*** define a wedge-like compartment whose width increases upwardly, as viewed in FIG. 2 or 3.

The lowermost panel **12*a* of the wall 12 has an elongated cutout or recess 20 which may but need not be as long as (or longer than) the length of the folded edge or back 40A of the jacket 40 of an assembled newspaper 140 in the respective pocket 2. The recess extends transversely of the direction of movement of pockets 2 along the path 1**.

The carrier 3 further supports a turnable shaft 21 (see FIGS. 3 or 4) for each pocket 2 thereon. The shafts 21 are parallel to the respective pairs of shafts 14, 15 and each thereof supports two spaced-apart levers 22 having lower end portions which are bent toward the respective first walls 11 (see particularly FIG. 3). Each shaft 21 is rigid with the respective levers 22 and its left-hand end portion (as viewed in FIG. 4) is rigid with a lever 51 for a roller follower 52 which tracks, at times, the upper side of a stationary cam 45 or 45' (see FIGS. 1 or 4) secured to the frame 58 of the stuffing apparatus. The configuration of the upper side of the cam 45 or 45' is such that the roller followers 52 can cause the associated levers 51 to pivot the corresponding shafts 21 (and hence the corresponding pairs of levers 22) between first and second positions in which the levers 22 are respectively adjacent and remote from the corresponding first walls 11. In their first or intercepting positions, the levers 22 preferably contact the respective first walls 11 and thus insure that a newspaper 140 which is located in the respective pocket 2 cannot escape by sliding downwardly between the walls 11 and 12. In the second positions, the levers 22 allow the removing unit 10 or 10' to withdraw an assembled newspaper 140 from the respective pocket 2.

Referring again to FIG. 2, the carrier 3 supports additional shafts 23, one for each pocket 2. One end of the shaft 23 shown in FIG. 2 is journalled in the carrier 3 and its other end extends into a bearing 24 at the outer side of the upper panel 11*a* of the first wall 11. The shaft 23 serves as a guide for a block-shaped holder 25 for a retaining blade 26. The holder 25 further carries an upwardly extending roller follower 27 and a downwardly extending projection or post 28 for a roller follower 29 received in an elongated U-shaped guide 30. The latter is fixedly secured to the shaft 23 by means of two upwardly extending beams 31 and 32 each having a polygonal outline. A helical spring 35 is connected to pins 33, 34 which are respectively secured to the holder 25 and beam 31; this spring tends to pull the blade 26 toward that end of the pocket 2 which is remote from the carrier 3.

The beam 32 supports a pivotable pawl 36 whose pallet can engage and retain the holder 25 for the blade 26, provided that the holder 25 is moved close to the carrier 3 to thereby cause the spring 35 to store energy. The pawl 36 has an upstanding protuberance 37 which can be moved to disengage the pawl from the holder 25 whereby the latter can move toward the beam 31 under the action of the spring 35, i.e., toward a central position (midway or substantially midway between the beams 31, 32) which is shown in FIG. 2.

The shaft 23 is further rigid with an L-shaped lever 38 which carries a roller follower 39. When the roller follower 39 is caused to move downwardly, as viewed in FIG. 2, the guide 30 is moved against the outer side and the blade 26 is moved away from the inner or front side of the wall 11.

When a pocket 2 travels below the primary hopper 8 of the first stuffer, the blade 26 is close to the respective carrier 3, i.e., the pallet of the pawl 36 engages the holder 25. Furthermore, the roller follower 19 allows the mobile wall 12 of such pocket 2 to assume the open position of FIG. 2 while the bent lower end portions of the corresponding levers 22 engage the front side of the lower panel 11*b* of the first wall 11. The hopper 8 discharges a jacket 40 whose folded edge or back 40A enters the pocket 2 therebelow ahead of the remaining portion of such jacket (see FIG. 3), and the folded edge 40A comes to rest on the levers 22 which can be said to constitute retractible intercepting means for jackets 40. The conveyor chain 6 continues to transport the partially filled pocket 2 along the endless path 1 whereby the roller follower 19 engages the stationary cam 41 (e.g., an elongated rail) which is shown in FIG. 1. The second cam 41' is mounted downstream of the primary hopper 8' of the second stuffer. The cam 41 causes the wall 12 to pivot toward the wall 11, i.e., the jacket 40 whose folded edge 40A rests on the levers 22 is clamped between the walls 11 and 12. As mentioned above, the uppermost panel 12*c* of the wall 12 and the upper panel 11*a* of the wall 11 define a wedge-like compartment when the lower panels 12*a*, 12*b* of the wall 12 are adjacent the wall 11; such compartment enables the upper portion of the jacket 40 in the pocket 2 to open up so as to provide room for entry of the blade 26.

The chain 6 continues to move the pocket 2 along the path 1 whereby the roller follower 39 of the lever 38 reaches and is engaged by the fixed (but preferably adjustably mounted) cam or rail 42 which is shown in FIG. 1 and causes the shaft 23 to turn anti-clockwise, as viewed in FIG. 2, against the opposition of a spring 43 which is attached to the beam 32. The blade 26 is thereby moved away from the upper panel 11*a* of the wall 11. The level of the cam or rail 42 in the frame 58 is selected in such a way that the blade 26 is pivoted to a position substantially midway between the upper panels 11*a*, 12*c* of the pocket 2, i.e., substantially into the central longitudinal symmetry plane of the aforementioned compartment. This insures that the blade 26 is then disposed in register with the gap between the halves of the opened-up jacket 40 in the pocket 2. A second adjustable cam or rail 42' is mounted downstream of the primary hopper 8' of the second stuffer.

The pocket 2 continues to move along the path 1 and the protuberance 37 of the pawl 36 strikes against and is pivoted by a stationary cam 44 (shown in FIG. 1) which automatically disengages the pallet of the pawl 36 from the holder 25 whereby the latter moves along the shaft 23 under the action of the spring 35. This causes the blade 26 to move into the gap between the halves of the jacket 40 in the pocket 2. Shortly or immediately thereafter, the roller follower 39 moves beyond the adjustable cam 42 so that the spring 43 is free to contract and turns the shaft 23 clockwise, as viewed in FIG. 2, in order to move the blade 26 against that half of the jacket 40 which lies against the inner side of upper panel 11*a* of the first wall 11.

During the next-following stage of movement of the pocket 2, the roller follower 19 moves beyond the cam 41 so that the wall 12 is free to pivot to the open position of FIG. 2. This enables one-half of the jacket 40 in the pocket 2 to follow the pivotal movement of the wall 12, i.e., the jacket opens up all the way to its folded edge 40A which rests on the intercepting levers 22. Such full opening of the jacket 40 is desirable and advantageous because it allows for introduction of a substantial number of inserts and because it further insures that the leading edge of each insert can slide all the way into the deepmost portion of the jacket 40. The inserts are admitted by the hoppers 9 which are located downstream of the cam 41 and upstream of the removing unit 10.

When the pocket 2 advances beyond the secondary hoppers 9, the roller follower 52 on the lever 51 reaches and engages the stationary cam 45 which causes the shaft 21 to pivot the levers 22 to their retracted positions (i.e., away from the fixed first wall 11) so as to enable the removing unit 10 to rapidly withdraw the fully assembled newspaper 140 (including a jacket 40 and one or more inserts therein) by way of the clearance between the lowermost panel 12*a* of the mobile second wall 12 (the wall 12 then dwells in the open position of FIG. 2) and the lower panel 11*b* of the first wall 11.

When the roller follower 52 engages the cam 45, the roller follower 27 engages a stationary cam 46 which pushes the holder 25 toward the carrier 3 to stress the spring 35 and to reengage the holder with the pallet of the pawl 36. Thus, the blade 26 is fully disengaged from the assembled newspaper 140 in the pocket 2 before the newspaper begins to leave the pocket. When the roller follower 52 moves beyond the cam 45, the intercepting levers 22 return into engagement with the wall 11 and the pocket 2 is ready to receive a jacket 40 from the primary hopper 8' of the second stuffer. The reference characters 44' and 46' denote in FIG. 1 cams which correspond to the cams 44 and 46 and are respectively located in the path of movement of successive protuberances 37 and successive roller followers 27 while the pockets 2 travel along that portion of the endless path 1 which is disposed between the removing units 10 and 10' (the pockets 2 are assumed to travel in a clockwise direction, as viewed in FIG. 1).

The means for arresting the blade 26 in the position of FIG. 2 (i.e., substantially midway between the ends of the recess 20) is not shown in the drawing. Such means may include suitable stops in the path of movement of the roller follower 27.

Figure 4:
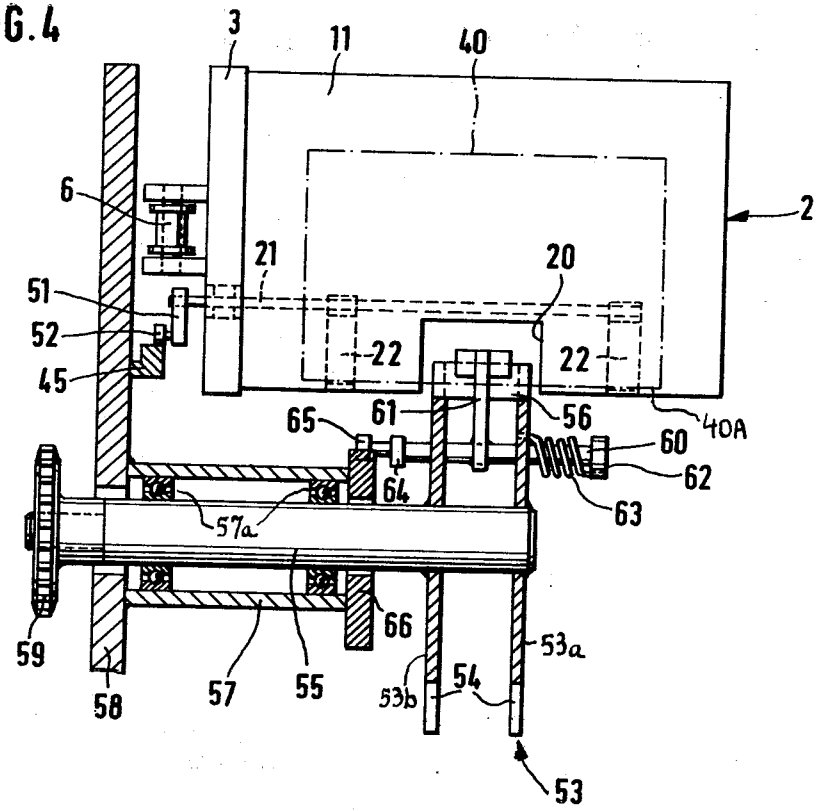
FIG. 4 is a transverse vertical sectional view as seen in the direction of arrows from the line IV—IV of FIG. 3.

FIGS. 3 and 4 illustrate the removing unit 10 (the unit 10' is identical with or clearly analogous to the unit 10 and will not be described). The removing unit 10 comprises a driven rotary member here shown as a wheel 53 which comprises two parallel disks **53*a*, 53*b* mounted on a shaft 55 which is driven by a chain transmission including a sprocket wheel 59. The shaft 55 rotates in anti-friction bearings 57*a* mounted in a bearing sleeve 57 which is affixed to the frame 58. The chain transmission including the sprocket wheel 59 receives motion from the main prime mover 7**.

The wheel 53 has four teeth 54 which are equally spaced from each other, as considered in the circumferential direction of the disks **53*a*, 53*b*. Each tooth 54 is composed of two spaced apart portions which are in exact register with each other, as considered in the axial direction of the shaft 55. The direction in which the wheel 53 rotates is indicated by arrow 53A (see FIG. 3). Each tooth space of the wheel 53 is bounded by the rearwardly inclined leading flank of the trailing tooth 54 and by the substantially radially extending trailing flank of the preceding tooth 54. The leading flank of each tooth 54 carries a plate-like stationary jaw or back support 56 which extends between the disks 53*a*, 53*b* in parallelism with the shaft 55**.

The disks **53*a*, 53*b* support four shafts 60 which are parallel to the shaft 55 and each of which is disposed inwardly of and substantially midway between the neighboring teeth 54. Each shaft 60 is rigid with a lever 61 which forms part of a gripper and the outermost portion of which carries a plate-like jaw 61*a* located opposite the respective back support or jaw 56. Furthermore, each shaft 60 has a collar 62 which is adjacent to but spaced apart from the outer side of the disk 53*a*. The collar 62 serves as a retainer for one end of a prestressed torsion spring 63 the other end of which is anchored in the disk 53*a* and which tends to pivot the shaft 60 in a direction to pivot the lever 61 and its jaw 61*a* toward the associated back support 56, i.e., to press the folded edge 40A of the jacket 40 forming part of an assembled newspaper 140 against the member 56**.

That end of each shaft 60 which is adjacent to but spaced from the outer side of the disk **53*b* carries a lever 64 for a roller follower 65 which tracks the periphery of a stationary disk cam 66 secured to the bearing sleeve 57. The levers 64 are angularly offset with respect to the corresponding levers 61, preferably by approximately 120° (see FIG. 3). The cam 66 can be replaced with a cam having an endless groove for the roller followers 65. Also, each set of gripping means in the removing unit 10 can comprise two mobile jaws which are movable toward and away from each other, i.e., into and out of engagement with the folded edges 40A of the adjacent jackets 40**.

The configuration of the peripheral surface of the cam 66 is such that each lever 61 which reaches a position directly above the shaft 55 (i.e., immediately below the adjacent portion of the endless path 1 for the pockets 2) is free to follow the bias of the associated torsion spring 63 and to pivot its jaw **61*a* toward the respective back support or jaw 56. The lever 61 then remains in such operative position until it reaches that position (below the shaft 55) in which the jaw 61*a* is located at a maximum distance from the path 1. The cam 66 then causes the jaw 61*a* to move away from the back support or jaw 56 and to release the folded edge 40A of the jacket 40 which has been withdrawn from a pocket 2 and transported onto the aforementioned conveyor system 67. Thus, each set of gripping means 56, 61*a* engages a newspaper 140 while the wheel 53** rotates through approximately 180°.

The RPM of the shaft 55 is synchronized with the speed of movement of pockets 2 along the path 1 in such a way that the lowermost portions of successive (filled) pockets 2 extend into successive oncoming spaces between neighboring teeth 54 of the wheel 53. As shown in FIG. 3, the tooth space at the 3 o'clock position of the wheel 53 is about to receive the lowermost portion of the pocket denoted by the reference character 202, the tooth space at the 12 o'clock position of the wheel 53 receives the lowermost portion of the pocket denoted by the reference character 302, and the jaw **61*a* in the tooth space at the 9 o'clock position of the wheel 53 is in the process of withdrawing the assembled newspaper 140 from the pocket which is denoted by the reference character 402**.

The operation of the removing unit 10 of FIGS. 3 and 4 is as follows:

When a pocket (302) moves to a level above the wheel 53, it contains a fully assembled newspaper 140 having a jacket 40 and one or more inserts. The levers 22 still engage the first wall 11 of the pocket 302 so that they prevent the newspaper 140 from sliding downwardly between the walls 11, 12 under the action of gravity. The folded edge 40A of the jacket 40 of such newspaper 140 is located between a jaw **61*a* and the associated back support or jaw 56. As mentioned above, the cam 66 causes such jaw 61*a* to move toward the respective back support 56 when the corresponding lever 61 is located directly above the shaft 55. At the same time, the cam 45 moves the levers 22 to retracted positions so that the path for extraction of the newspaper 140 is unobstructed and the jaw 61*a* co-operates with back support 56 to withdraw the newspaper from the pocket 302 in response to further anticlockwise rotation of the wheel 53. The lever 61 is pivoted in a direction to move the jaw 61*a* away from the back support 56 when such lever assumes a position directly below the shaft 55; at such time, a substantial part of the respective newspaper 140 is already supported by a belt or chain conveyor 67*a* of the conveyor system 67. The conveyor 67*a* delivers the fully released newspaper 140 to a further belt or chain conveyor 67*b* which transports the newspaper toward a stacker, not shown. The conveyor system 67 receives a newspaper 140 whenever the wheel 53** completes an angular movement through 90°, and such newspapers may but need not form a scalloped stream.

An important advantage of the improved apparatus is that its removing units 10 and 10' can withdraw successive newspapers 140 at a rate greatly exceeding the rate of evacuation of newspapers from the pockets of a conventional apparatus. This is due to the fact that the improved apparatus does not rely on gravity but effects positive evacuation of the contents of pockets 2 at a speed which is best suited to insure that the apparatus can process the entire output of a high-speed printing press. FIG. 3 shows that the lowermost parts of successive assembled newspapers resemble the teeth of a toothed rack and that the wheel 53 resembles a pinion which mates with the teeth of such imaginary rack. The front flank of a tooth 54 which is about to engage the lowermost portion of a newspaper 140 is parallel or nearly parallel to the general plane of such newspaper.

As mentioned above, the levers 22 return to operative positions as soon as they advance beyond the removing unit 10 or 10', i.e., as soon as an assembled newspaper 140 is fully withdrawn from the respective pocket 2. The pocket is then ready to receive a fresh jacket, either from the hopper 8 or from the hopper 8'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for collating and otherwise manipulating sheet material articles, particularly in a newspaper stuffing apparatus, a combination comprising a plurality of pockets; means for transporting said pockets in a predetermined direction along a predetermined path; means for feeding different sheet material articles into successive pockets in at least two different portions of said path; and means for withdrawing the articles from successive pockets in a further portion of said path including means to allow the articles to be withdrawn from the respective pockets, said further portion being located downstream of said first mentioned portions, as considered in said direction, said withdrawing means including means for gripping the articles while in the pockets and moving the articles out of the pockets when the articles are allowed to be withdrawn from the respective pockets at said further portion of said path.

2. A combination as defined in claim 1, wherein said path is located at a level above said withdrawing means.

3. A combination as defined in claim 2, wherein each of said pockets comprises a lower portion having a recess into which portions of articles in the respective pockets extend, said gripping means including at least one set of mobile components and means for moving such mobile components toward the recesses of oncoming pockets as well as for moving said mobile components relative to each other in a direction to grip said portions of articles in a pocket which is located in said further portion of said path.

4. A combination as defined in claim 1, wherein said feeding means comprises a first bottom-feed hopper for newspaper jackets and at least one additional bottom-feed hopper disposed downstream of said first hopper, as considered in said direction, and arranged to deliver newspaper inserts into opened-up jackets in successive pockets.

5. In an apparatus for collating and otherwise manipulating sheet material articles, particularly in a newspaper stuffing apparatus, a combination comprising a plurality of pockets; means for transporting said pockets in a predetermined direction along a predetermined path; means for feeding different sheet material articles into successive pockets in at least two different portions of said path, each of said pockets comprising a lower portion having a recess into which portions of articles in the respective pocket extend; and means for withdrawing the articles from successive pockets in a further portion of said path downstream of said first mentioned portions, as considered in said direction, including means for gripping the articles in the pockets in said further portion of said path, said path being located at a level above said withdrawing means and said gripping means including at least one set of mobile components and means for moving such mobile components toward the recesses of oncoming pockets as well as for moving said mobile components relative to each other in a direction to grip said portions of articles in a pocket which is located in said further portion of said path, said moving means comprising a rotary member having a plurality of teeth and tooth spaces between said teeth and said gripping means including a discrete set of mobile components for each of said tooth spaces and each of said sets including a first jaw on said rotary member and a second jaw movable toward and away from the respective first jaw to thereby grip said portions of articles in a pocket on movement of said second jaw toward the respective first jaw, said withdrawing means further comprising means for driving said rotary member in synchronism with said transporting means so as to place successive tooth spaces into register with the recesses of successive pockets.

6. A combination as defined in claim 5, wherein said path is an endless path and said withdrawing means further comprises means for maintaining said jaws of successive sets of components in engagement with the removed contents of a pocket while said rotary member turns through approximately 180°.

7. A combination as defined in claim 5, further comprising a plurality of intercepting means, at least one for each of said pockets and each movable to and from an operative position in which said intercepting means extend across portions of the respective pockets to thus prevent the evacuation of articles during travel of the respective pockets toward said further portion of said path, and means for moving said intercepting means from said operative positions in response to arrival of the respective pockets into said further portion of said path.

8. A combination as defined in claim 7, wherein said intercepting means are pivotable to and from said operative positions thereof.

9. A combination as defined in claim 5, wherein each of said teeth has a leading flank which is at least substantially parallel with said portions of articles in the adjacent pocket during entry of such portion into the respective tooth space.

10. A combination as defined in claim 5, wherein each of said sets further includes a lever pivotably mounted on said rotary member and supporting the respective second jaw.

11. A combination as defined in claim 5, further comprising mechanical means for opening and closing said pockets, mechanical means for moving said second jaws, a plurality of intercepting means, at least one for each of said pockets and each movable to and from an operative position in which said intercepting means extend across portions of the respective pockets to prevent the withdrawal of articles from the respective pockets in said operative positions of said intercepting means, and mechanical means for moving said intercepting means from said operative positions upon arrival of the respective pockets into said further portion of said path.

* * * * *